US008547075B1

(12) United States Patent
Mosinskis et al.

(10) Patent No.: US 8,547,075 B1
(45) Date of Patent: Oct. 1, 2013

(54) VOLTAGE REGULATORS WITH A SHARED CAPACITOR

(75) Inventors: Paulius Mosinskis, Richlandtown, PA (US); Keith Montgomery, Easton, PA (US)

(73) Assignee: Lattice Semiconductor Corporation, Hillsboro, OR (US)

( * ) Notice: Subject to any disclaimer, the term of this patent is extended or adjusted under 35 U.S.C. 154(b) by 29 days.

(21) Appl. No.: 13/155,547

(22) Filed: Jun. 8, 2011

(51) Int. Cl.
*G05F 1/00* (2006.01)

(52) U.S. Cl.
USPC ..... 323/269; 323/224

(58) Field of Classification Search
USPC ..... 323/268–269, 224, 226, 267, 273; 363/59, 60; 327/536; 307/109, 110
See application file for complete search history.

(56) References Cited

U.S. PATENT DOCUMENTS

| | | | | |
|---|---|---|---|---|
| 4,301,501 | A * | 11/1981 | Carter et al. | 363/62 |
| 7,821,244 | B1 | 10/2010 | Signoretti et al. | |
| 7,990,741 | B2 * | 8/2011 | Martinussen | 363/60 |
| 8,040,174 | B2 * | 10/2011 | Likhterov | 327/536 |
| 8,120,338 | B2 * | 2/2012 | Kawagishi et al. | 323/272 |
| 2005/0122751 | A1 * | 6/2005 | Zeng et al. | 363/50 |
| 2008/0088179 | A1 * | 4/2008 | Oyama et al. | 307/28 |
| 2009/0237046 | A1 * | 9/2009 | Hsieh et al. | 323/273 |
| 2009/0315615 | A1 * | 12/2009 | Likhterov | 327/536 |
| 2010/0181974 | A1 * | 7/2010 | Chen | 363/282 |
| 2010/0264890 | A1 * | 10/2010 | Caldwell | 323/282 |
| 2010/0289476 | A1 * | 11/2010 | Azimi et al. | 323/350 |

FOREIGN PATENT DOCUMENTS

EP 1 753 117 A2 2/2007

* cited by examiner

*Primary Examiner* — Gary L Laxton
*Assistant Examiner* — Kyle J Moody

(57) ABSTRACT

In one embodiment, an integrated circuit (e.g., FPGA) has two voltage regulators sharing stability and filter capacitors. A switch is located between each plate of each capacitor and a common voltage reference (e.g., ground) such that one of the two voltage regulators can be selectively connected to ground via the stability and filter capacitors.

7 Claims, 2 Drawing Sheets

100

200

VOLTAGE REGULATORS WITH A SHARED CAPACITOR

TECHNICAL FIELD

The present invention relates to integrated circuits (ICs), such as field-programmable gate arrays (FPGAs), and, more specifically but not exclusively, to ICs having voltage regulators.

BACKGROUND

This section introduces aspects that may help facilitate a better understanding of the invention. Accordingly, the statements of this section are to be read in this light and are not to be understood as admissions about what is prior art or what is not prior art.

On-chip voltage regulators often require a substantial area. In the case of linear regulators with high power supply rejection requirements, this area is dominated primarily by the filter capacitor and secondarily by the capacitors used to stabilize the circuit, known as stability capacitors. If two different voltages are required, then two different voltage regulators are often used, and the filter and stability capacitors are either duplicated or switched using traditional series switches.

Duplication of the capacitors results in a doubling of the largest portions of the area associated with voltage regulators. To avoid duplication of capacitors, conventional solutions that use transistors as switches in series with the capacitors either (a) require a switch similar in size to the capacitor being switched, thus negating the area benefit of reusing the capacitor, or (b) create a zero in the transfer function of the capacitor, thereby significantly reducing its capacitance.

SUMMARY

In one embodiment, the present invention is an integrated circuit having first and second voltage regulators sharing (at least) a first capacitor. The integrated circuit comprises (1) a first switch located between the first capacitor and a voltage reference (e.g., ground) and (2) a second switch located between the first capacitor and the voltage reference. To operate the first voltage regulator, the first switch is closed, and the second switch is open, such that a first plate of the first capacitor is connected to the voltage reference. To operate the second voltage regulator, the first switch is open, and the second switch is closed, such that a second plate of the first capacitor is connected to the voltage reference.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 1:
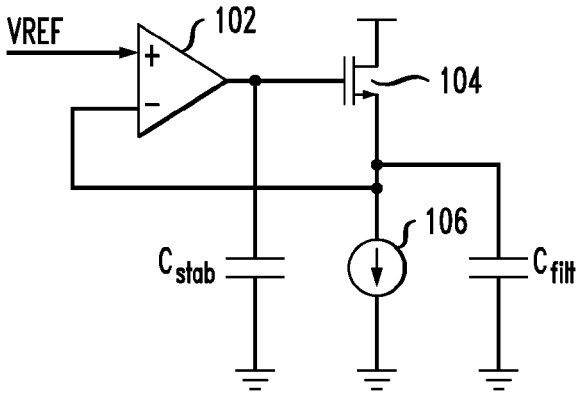
FIG. 1 PRIOR ART
FIG. 1 is a schematic diagram of a portion of an integrated circuit having a conventional voltage regulator.

FIG. 1 is a schematic diagram of a portion of an integrated circuit having a conventional voltage regulator 100 comprising an operational amplifier (op amp) 102, an output stage 104, a current sink 106, a filter capacitor $C_{filt}$, and a stability capacitor $C_{stab}$. In an application in which high power supply rejection is required, output stage 104 is typically implemented as an NMOS output stage, as illustrated in FIG. 1. As described previously, filter capacitor $C_{filt}$ and stability capacitor $C_{stab}$ generally dominate the regulator area.

Figure 2:
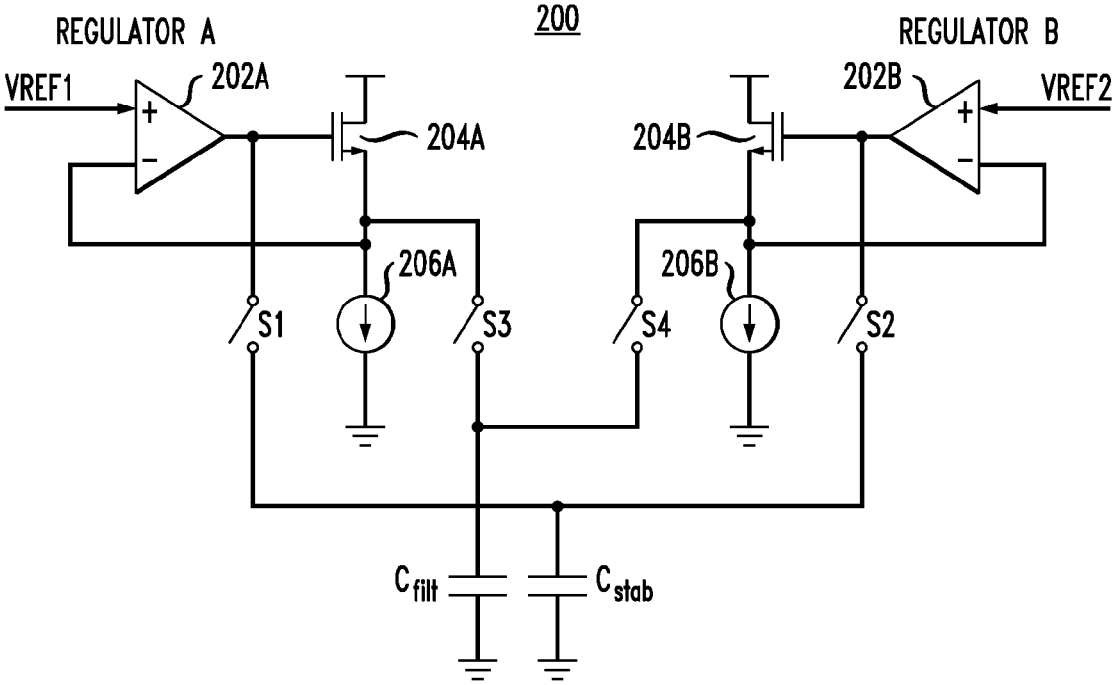
FIG. 2 PRIOR ART
FIG. 2 is a schematic diagram of a portion of an integrated circuit having two conventional voltage regulators.

FIG. 2 is a schematic diagram of a portion of an integrated circuit 200 having two conventional voltage regulators A and B, each comprising an op amp 202 (202A and 202B, respectively), an NMOS output stage 204 (204A and 204B, respectively), and a current sink 206 (206A and 206B, respectively). If only one of voltage regulators A and B needs to be on at a time, then it would be desirable to reuse the capacitors from the off regulator so that area can be reduced. To that end, the two voltage regulators have series switches S1-S4 that enable the voltage regulators to share a single filter capacitor $C_{filt}$ and a single stability capacitor $C_{stab}$.

Operationally, if voltage regulator A is to be used, then switches 51 and S3 are closed, and switches S2 and S4 are open. Similarly, if voltage regulator B is to be used, then switches S2 and S4 are closed, and switches 51 and S3 are open.

As described previously, this configuration has the following problem. Since switches S1-S4 need to operate at voltages near the regulated voltage, they must either be large or add resistance in series with the capacitor. Adding resistance in series with the capacitor creates a zero in the transfer function of the capacitor, significantly reducing its effective capacitance. If the regulated voltage is at or above the middle of the power supply range, avoiding such resistance requires switches that can approach the sizes of the filter and/or stabilization capacitors, reducing or eliminating the size-reduction benefits of this reuse technique.

Figure 3:
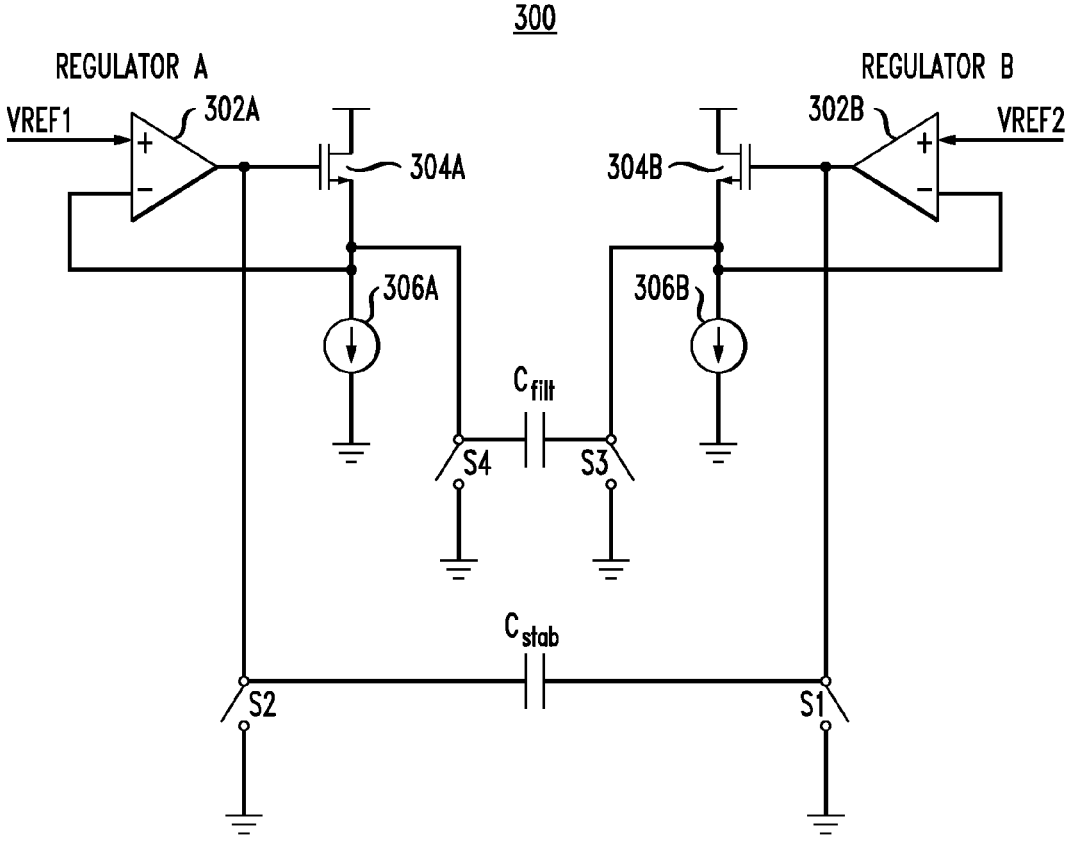
FIG. 3 is a schematic diagram of a portion of an integrated circuit, according to one embodiment of the present invention, having two voltage regulators.

FIG. 3 is a schematic diagram of a portion of an integrated circuit 300, according to one embodiment of the present invention, having two voltage regulators A and B, each comprising an op amp 302 (302A and 302B, respectively), an NMOS output stage 304 (304A and 304B, respectively), and a current sink 306 (306A and 306B, respectively). As with integrate circuit 200 of FIG. 2, only one of voltage regulators A and B of integrated circuit 300 needs to be on at a time. In order to reuse the capacitors from the off regulator so that area can be reduced, the two voltage regulators have switches S1-S4 that enable the voltage regulators to share a single filter capacitor $C_{filt}$ and a single stability capacitor $C_{stab}$.

Operationally, if voltage regulator A is to be used, then switches S1 and S3 are closed, and switches S2 and S4 are open. Similarly, if voltage regulator B is to be used, then switches S2 and S4 are closed, and switches S1 and S3 are open. Note that this switch arrangement forces both capacitors to have their plates inverted for the two different voltage regulators. As such, using capacitors that have a voltage-dependent capacitance (e.g., electrolytic capacitors, NMOS in NWELL MOS capacitors) might not be suitable for the filter and stability capacitors, since their capacitances could be radically different in the two different operating modes. On the other hand, if the two voltage regulators were specifically designed to operate with those different capacitance levels, then such voltage-dependent capacitors could be used.

Because each switch has one side tied directly to ground, instead of being located between a circuit node and a capacitor terminal as in FIG. 2, the switches now operate near a ground potential. If CMOS switches are used, this allows the use of the full power supply on their gates, in turn allowing a significant reduction in switch size for the same series resistance (approximately 7× in a typical deep sub-micron process). This, in turn, enables use of both the filter and stabilization capacitors by both regulators.

Note that, when switches S1 and S3 are closed, the output of op amp 302B and the gate and source of NMOS output stage 304B of voltage regulator B are all connected to ground. There are no adverse effects from these connections, because, when switches S1 and S3 are closed, it is assumed that voltage regulator B is off. Similarly, when switches S2 and S4 are closed, voltage regulator A is off, and there are no adverse effects from the output of op amp 302A and the gate and source of NMOS output stage 304A of voltage regulator A all being connected to ground.

Circuits according to certain embodiments of the present invention allow the filter and stability capacitors of a voltage regulator to be switched between two different voltage regulators in such a way that (a) area is not significantly increased and (b) performance of the two voltage regulators is nearly identical to what the performance would be if the two voltage regulators were implemented as two completely distinct circuits without any reuse (i.e., sharing) of capacitors.

Although represented in FIG. 3 as single capacitors, each of filter capacitor $C_{filt}$ and a stability capacitor $C_{stab}$ can be implemented using one or more distinct capacitors, including voltage-dependent capacitor pairs in which the pairs are used to cancel each other's voltage dependencies. Such cancellation method are well known to those skilled in the art.

Although the present invention has been described in the context of voltage regulators having switches located between a corresponding capacitor and ground, those skilled in the art will understand that the present invention can be implemented in the context of suitable voltage references for the regulator circuits other than ground.

Although the present invention has been described in the context of voltage regulators having an NMOS output stage, those skilled in the art will understand that the present invention can also be implemented in other contexts using any other suitable transistor technology, such as PMOS, bipolar, npn, and pnp technologies. In the context of these other technologies, the location and polarity of the switches might have to be rearranged.

Although the present invention has been described in the context of voltage regulators having an operational amplifier 302, an output stage 304, and a current sink 306, those skilled in the art will understand that the present invention can be implemented in the context of other types of voltage regulators having other regulator topologies that can take advantage of this type of capacitor swapping/inversion/sharing.

Although the present invention has been described in the context of an integrated circuit having a pair of voltage regulators A and B sharing capacitors, those skilled in the art will understand that the present invention can be implemented in the context of integrated circuits having one or more pairs of voltage regulators, each different pair sharing different capacitors and capable of generating a different pair of reference voltages.

The present invention can be implemented in the context of any suitable type of integrated circuit device, such as, without limitation, application-specific integrated circuits (ASICs), field-programmable gate arrays (FPGAs), programmable logic devices (PLDs), mask-programmable gate arrays (MPGAs), simple programmable logic devices (SPLDs), and complex programmable logic devices (CPLDs).

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

Also, for purposes of this description, it is understood that all gates are powered from a fixed-voltage power domain (or domains) and ground unless shown otherwise. Accordingly, all digital signals generally have voltages that range from approximately ground potential to that of one of the power domains and transition (slew) quickly. However and unless stated otherwise, ground may be considered a power source having a voltage of approximately zero volts, and a power source having any desired voltage may be substituted for ground. Therefore, all gates may be powered by at least two power sources, with the attendant digital signals therefrom having voltages that range between the approximate voltages of the power sources.

Signals and corresponding nodes or ports may be referred to by the same name and are interchangeable for purposes here.

Transistors are typically shown as single devices for illustrative purposes. However, it is understood by those with skill in the art that transistors will have various sizes (e.g., gate width and length) and characteristics (e.g., threshold voltage, gain, etc.) and may consist of multiple transistors coupled in parallel to get desired electrical characteristics from the combination. Further, the illustrated transistors may be composite transistors.

It should be appreciated by those of ordinary skill in the art that any block diagrams herein represent conceptual views of illustrative circuitry embodying the principles of the invention.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the scope of the invention as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. An integrated circuit comprising:

a first voltage regulator including:

an operational amplifier (op amp) having an input and a first output, the input connected to an internal node;

an output stage having an input and a second output, the input connected to the first output of the op amp and the second output connected to the internal node; and a current sink connected to the internal node;

a second voltage regulator including:

an operational amplifier (op amp) having an input and a first output, the input connected to an internal node;

an output stage having an input and a second output, the input connected to the first output of the op amp and the second output connected to the internal node; and a current sink connected to the internal node;

first and second switches, each switch having a first terminal for directly connecting the switch to a common voltage reference and a second terminal; and a first capacitor having first and second plates, the first plate connected to the second terminal of the first switch and the internal node of the second voltage regulator and the second plate connected to the second terminal of the second switch and the internal node of the first voltage regulator, wherein:

to operate the first voltage regulator, the first switch is closed and the second switch is open, such that the first plate of the first capacitor is directly connected to the common voltage reference and the second plate of the first capacitor is connected to the internal node of the first voltage regulator; and to operate the second voltage regulator, the first switch is open and the second switch is closed, such that the first plate of the first capacitor is connected the internal node of the second voltage regulator and the second plate of the first capacitor is directly connected to the common voltage reference.

2. The integrated circuit of claim 1, wherein the first capacitor is a filter capacitor.

3. The integrated circuit of claim 1 including:

third and fourth switches of the third and fourth switches having a first terminal for connecting the switch to the common voltage reference and a second terminal; and a second capacitor having first and second plates, the first plate of the second capacitor connected to the second terminal of the third switch and the first output of the op amp of the second voltage regulator and the second plate of the second capacitor connected to the second terminal of the fourth switch and the first output of the op amp of the first voltage regulator, wherein:

to operate the first voltage regulator, the third switch is closed and the second switch is open, such that the first plate of the second capacitor is connected to the common voltage reference and the second plate of the first capacitor is connected to the first output of the op amp of the first voltage regulator; and to operate the second voltage regulator, the first switch is open and the second switch is closed, such that the first plate of the first capacitor is connected to the first output of the op amp of the second voltage regulator and the second plate of the first capacitor is connected to the common voltage reference.

4. The integrated circuit of claim 3, wherein the second capacitor is a stability capacitor.

5. An integrated circuit comprising:

a first voltage regulator including a first operational amplifier (op amp) and an output stage connected to an output of the first op amp;

a second voltage regulator including a second operational amplifier (op amp) and an output stage connected to an output of the second op amp;

first and second switches, each switch having a first terminal for connecting the switch to a common voltage reference and a second terminal;

a stability capacitor having first and second plates, the first plate connected to the second terminal of the first switch and the output of the op amp of the second voltage regulator and the second plate connected to the second terminal of the second switch and the output of the op amp of the first voltage regulator;

third and fourth switches, each of the third and fourth switches having a first terminal for directly connecting the switch to the common voltage reference and a second terminal; and a filter capacitor having first and second plates, the first plate connected to the second terminal of the third switch and an output of the output stage of the second voltage regulator and the second plate connected to the second terminal of the fourth switch and an output of the output stage of the first voltage regulator.

6. The integrated circuit of claim 5, wherein:

an input of the first op amp is connected to the output of the output stage of the first voltage regulator; and an input of the second op amp is connected to the output of the output stage of the second voltage regulator.

7. The integrated circuit of claim 5, wherein:

the first voltage regulator includes:

a current sink; and the current sink, the output of the output stage of the first voltage regulator, and the input of the first op amp are connected to an internal node of the first voltage regulator; and the second voltage regulator includes:

a current sink; and the current sink, the output of the output stage of the second voltage regulator, and the input of the second op amp are connected to an internal node of the second voltage regulator.

* * * * *